US006049200A

United States Patent [19]

Hayashimoto

[11] Patent Number: 6,049,200

[45] Date of Patent: Apr. 11, 2000

[54] VOLTAGE REGULATOR CAPABLE OF LOWERING VOLTAGE APPLIED ACROSS PHASE COMPENSATING CAPACITOR

[75] Inventor: Hajime Hayashimoto, Kanagawa, Japan

[73] Assignee: NEC Corporation, Tokyo, Japan

[21] Appl. No.: 09/306,801

[22] Filed: May 7, 1999

[30] Foreign Application Priority Data

May 22, 1998 [JP] Japan ..... 10-140944

[51] Int. Cl.[7] ..... G05F 1/40

[52] U.S. Cl. ..... 323/269; 323/281

[58] Field of Search ..... 323/269, 280, 323/281

[56] References Cited

U.S. PATENT DOCUMENTS 5,686,820 11/1997 Riggio, Jr. ..... 323/280

FOREIGN PATENT DOCUMENTS 58-218209 12/1983 Japan .

2-71559 3/1990 Japan .

7-106871 4/1995 Japan .

*Primary Examiner*—Edward H. Tso

*Assistant Examiner*—Gary L. Laxton

*Attorney, Agent, or Firm*—Sughrue, Mion, Zinn Macpeak & Seas, PLLC

[57] ABSTRACT

There is provided a voltage regulator capable of lowering a voltage applied across a phase compensating capacitor even at the time of a high voltage output and of reducing an area of the phase compensating capacitor by forming it with a thin insulating film. Phase compensating circuit 61 included in the voltage regulator comprises phase compensating capacitor C1, P-channel MOS transistor P1, N-channel MOS transistor N2 and voltage generating circuit 71 for generating a constant voltage. When gate-source voltages of P-channel MOS transistor P1 and N-channel MOS transistor N2 are Vgs(N2) and Vgs(P1), respectively, a voltage applied across capacitor C1 becomes Vgs(N2)+Vgs(P1) regardless of an input voltage applied to input terminal 1, and is suppressed to low.

11 Claims, 7 Drawing Sheets

VOLTAGE REGULATOR CAPABLE OF LOWERING VOLTAGE APPLIED ACROSS PHASE COMPENSATING CAPACITOR

BACKGROUND OF THE INVENTION

1. Field of the Invention

The present invention relates to a voltage regulator and more particularly, to a voltage regulator capable of lowering a voltage applied across a phase compensating capacitor.

2. Description of the Prior Art

First, a conventional example of a generally and widely used voltage regulator shown in FIG. 6 will be explained.

The voltage regulator of FIG. 6 comprises: reference voltage source 4, to which power is supplied from input terminal 1, and which generates a reference voltage at output terminal 41; error amplifier 5 having a non-inverting input terminal to which the reference voltage is applied; output transistor N1 consisting of an N-channel MOS transistor which has a drain connected to input terminal 1, a gate connected to output terminal 51 of error amplifier 5 and a source connected to output terminal 3; resistors R1 and R2, connected in series between output terminal 3 and ground terminal 2, whose cross point is connected to an inverting input terminal of error amplifier 5; and phase compensating capacitor C10 having one end portion connected to output terminal 51 and the other end portion connected to ground terminal 2.

Output voltage Vout at output terminal 3 is, based on reference voltage Vr which appears at the output terminal of reference voltage source 4, represented by the following equation (1):

$$Vout=(1+R1/R2)\cdot Vr \quad (1)$$

wherein R1 and R2 stand for resistance values of resistors R1 and R2, respectively. Error amplifier 5 controls a gate voltage of transistor N1 so that a voltage at the cross point of resistors R1 and R2 becomes equal to reference voltage Vr.

In general, phase compensating capacitor C10 comprises a so-called MOS capacitor which has a capacitor insulating film consisting of an oxide film with a small bias voltage dependence and less leak current. Capacitance Cox of the MOS capacitor is represented by the following equation (2):

$$Cox=\epsilon ox\cdot\epsilon 0/Tox \quad (2)$$

wherein $\epsilon$ ox stands for a relative permittivity of the oxide film, $\epsilon$ 0 stands for a permittivity in a vacuum ($=8.854\times10^{-14}$ F/cm), and Tox denotes a thickness of the oxide film. From the equation (2), it is apparent that the thinner the thickness Tox of the oxide film, the larger the capacity value per unit area.

When output voltage Vout is equal to 15V, a voltage composed of 15V and gate-source voltage Vgs(N1) of output transistor N1 added thereto is applied to a high potential side of phase compensating capacitor C10. Therefore, if a gate oxide film of the MOS transistor is used as the oxide film of MOS capacitor C10, an electric field of (15V+Vgs(N1))/Tox is applied across the gate oxide film which forms MOS capacitor C10.

If Vgs(N1)=0.6V and Tox=10 nm (nanometer), an electric field of 15.6 V/10 nm is generated across MOS capacitor C10. The electric field is equal to, or more than three times the breakdown electric field intensity, 5/10 nm, of the 10 nm thick oxide film. Thus, the gate oxide film having a large capacity per unit area can not be used as the oxide film of MOS capacitor C10.

Because of the above reason, there is a disadvantage that a thick oxide film such as a field oxide film must be used for the oxide film in phase compensating capacitor C10 and the capacity value per unit area becomes small, whereby an area of the MOS capacitor becomes large.

With respect to an operational amplifier which comprises a phase compensating circuit consisting of a capacitor and a MOS transistor, and a voltage generating circuit for applying a constant voltage to a gate of the MOS transistor, a technique disclosed in JPA 07-106871 may be referred. Phase compensating circuit 65 and voltage generating circuit 72 which configure the operational amplifier explained in the above publication will be explained with reference to FIG. 7.

Phase compensating circuit 65 shown in FIG. 7 consists of capacitor C11 whose one end portion is connected to output terminal 30 of the operational amplifier, and N-channel MOS transistor N15 whose drain is connected to the other end portion of capacitor C11 and whose gate is connected to output terminal 14 of voltage generating circuit 72.

Voltage generating circuit 72 consists of P-channel MOS transistor P5 whose source is connected to supply terminal 1*a* and whose gate and drain are connected in common to one end portion of resistor R4, and resistor R4 whose the other end portion is connected to the ground terminal.

When the output voltage of output terminal 30 is equal to 15V similarly to the above-explained case, the voltage of 15V is applied to the high potential side of phase compensating capacitor C11. On the other hand, the low potential side of phase compensating capacitor C11, which is connected to the gate of N-channel MOS transistor N6 through an ON-resistance of N-channel MOS transistor N15, has a voltage of about 0.6V.

Therefore, as a voltage of approximately 15V−0.6V=14.4V is applied across capacitor C11, the MOS capacitor formed with the gate oxide film having the large capacitance value per unit area cannot be used. As a result, there is a disadvantage that an area of capacitor C11 becomes large.

In the aforementioned conventional voltage regulator and operational amplifier, because of the high voltage applied to the MOS capacitor for the use of phase compensation, the gate oxide film with a large capacitance value per unit area can not be used for the oxide film of the MOS capacitor. Therefore, there is a disadvantage that the thick oxide film such as the field oxide film must be used for the oxide film, the area size of the MOS capacitor becomes large, and the area size of the voltage regulator which contains the phase compensating circuit therein also becomes large.

SUMMARY OF THE INVENTION

In order to overcome the aforementioned disadvantages, the present invention has been made and accordingly, has an object to provide a voltage regulator capable of lowering the voltage applied across the phase compensating capacitor even under a high output voltage, and of reducing the area size of the voltage regulator which contains the phase compensating capacitor and the phase compensating circuit therein by forming the phase compensating capacitor with a thin insulating film.

According to a first aspect of the present invention, there is provided a voltage regulator which comprises: an input terminal for receiving an input voltage; a ground terminal; a final output terminal; a reference voltage source for outputting a reference voltage; an output transistor for outputting a constant output voltage which has a drain connected to the input terminal and a source connected to the final output terminal; an amplifier for amplifying the reference voltage which has an output terminal connected to a gate of the output transistor; and a phase compensating circuit connected to the output terminal of the amplifier, wherein the phase compensating circuit comprises: a voltage generating circuit for generating a constant voltage; a first MOS transistor having a drain connected to the input terminal and a gate connected to the output terminal of the amplifier; a second MOS transistor having a source connected to the source of the first MOS transistor, and a drain and a gate connected in common to an output terminal of the voltage generating circuit; and a first phase compensating capacitor having two terminals, one of the two terminals being connected to the gate of the first MOS transistor and the other of the two terminals being connected to the gate of the second MOS transistor.

The voltage regulator according to the first aspect may further comprise a voltage dividing circuit for outputting a divided voltage of the constant output voltage which is connected between the final output terminal and the ground terminal, wherein the amplifier amplifies a differential voltage between the reference voltage applied to a non-inverting input terminal and the divided voltage applied to an inverting input terminal.

The voltage regulator according to the first aspect may further comprise a current regulator for flowing a constant current which is inserted between the input terminal and the drain of the first MOS transistor.

The voltage regulator according to the first aspect may further comprise a second phase compensating capacitor for phase compensation which is inserted between the gate of the output transistor and the ground terminal.

In the voltage regulator according to the first aspect, an insulating film between both electrodes of the first phase compensating capacitor may comprise a gate film of a MOS transistor.

In the voltage regulator according to the first aspect, the voltage generating circuit may comprises a serial circuit containing any one or more selected from a group consisting of P-channel transistors each having a gate and a drain connected to each other, N-channel transistors each having a gate and a drain connected to each other, PN junction diodes, and resistors.

In the voltage regulator according to the first aspect, an insulating film between both electrodes of the second phase compensating capacitor may comprise a gate film of a MOS transistor.

According to a second aspect of the present invention, there is provided a voltage regulator which comprises: an input terminal for receiving an input voltage; a ground terminal; a final output terminal; a reference voltage source for outputting a reference voltage; an output transistor for outputting a constant output voltage which has a drain connected to the input terminal and a source connected to the final output terminal; an amplifier for amplifying the reference voltage which has an output terminal connected to a gate of the output transistor; and a phase compensating circuit connected to the output terminal of the amplifier, wherein the phase compensating circuit comprises: a voltage generating circuit for generating a constant voltage; and a phase compensating capacitor having two terminals, one of the two terminals being connected to the gate of the output transistor and the other of the two terminals being connected to an output terminal of the voltage generating circuit.

The voltage regulator according to the second aspect may further comprise a voltage dividing circuit for outputting a divided voltage of the constant output voltage which is connected between the final output terminal and the ground terminal, wherein the amplifier amplifies a differential voltage between the reference voltage applied to a non-inverting input terminal and the divided voltage applied to an inverting input terminal.

In the voltage regulator according to the second aspect, an insulating film between both electrodes of the first phase compensating capacitor may comprise a gate film of a MOS transistor.

In the voltage regulator according to the second aspect, the voltage generating circuit may comprise a serial circuit containing any one or more selected from a group consisting of P-channel transistors each having a gate and a drain connected to each other, N-channel transistors each having a gate and a drain connected to each other, PN junction diodes, and resistors.

BRIEF DESCRIPTION OF THE DRAWINGS

The present invention will be more fully understood from the following detailed explanation with reference to the accompanying drawings in which.

DETAILED DESCRIPTION OF THE PREFERRED EMBODIMENTS

Next, embodiments of the present invention will be explained with reference to the drawings.

Figure 1:
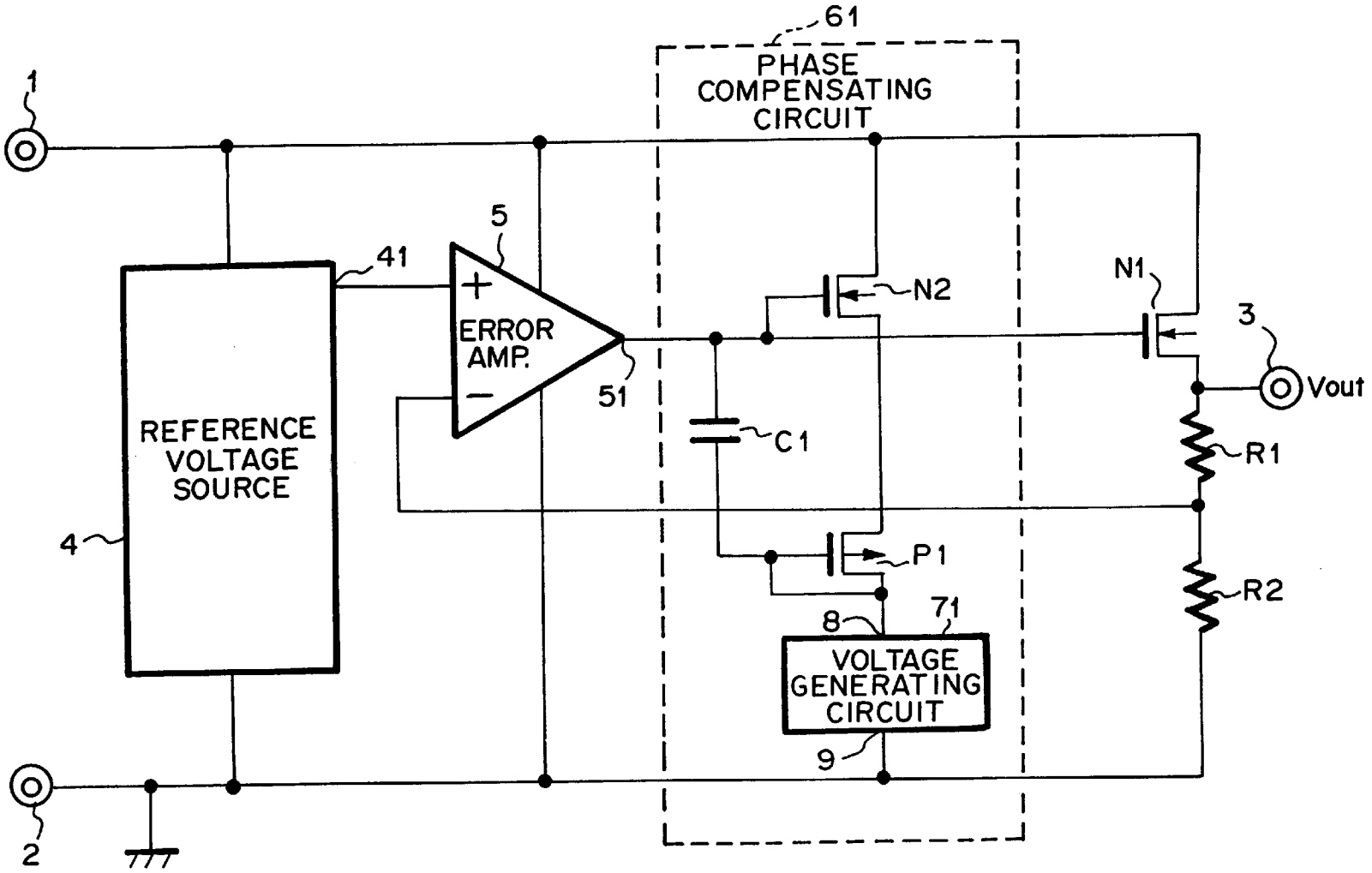
FIG. 1 is a circuit diagram showing a voltage regulator according to a first embodiment of the present invention.

FIG. 1 shows a circuit diagram according to the first embodiment of the present invention. The common reference characters/numerals are herein given to the same constituents as those in FIG. 6.

Figure 6:
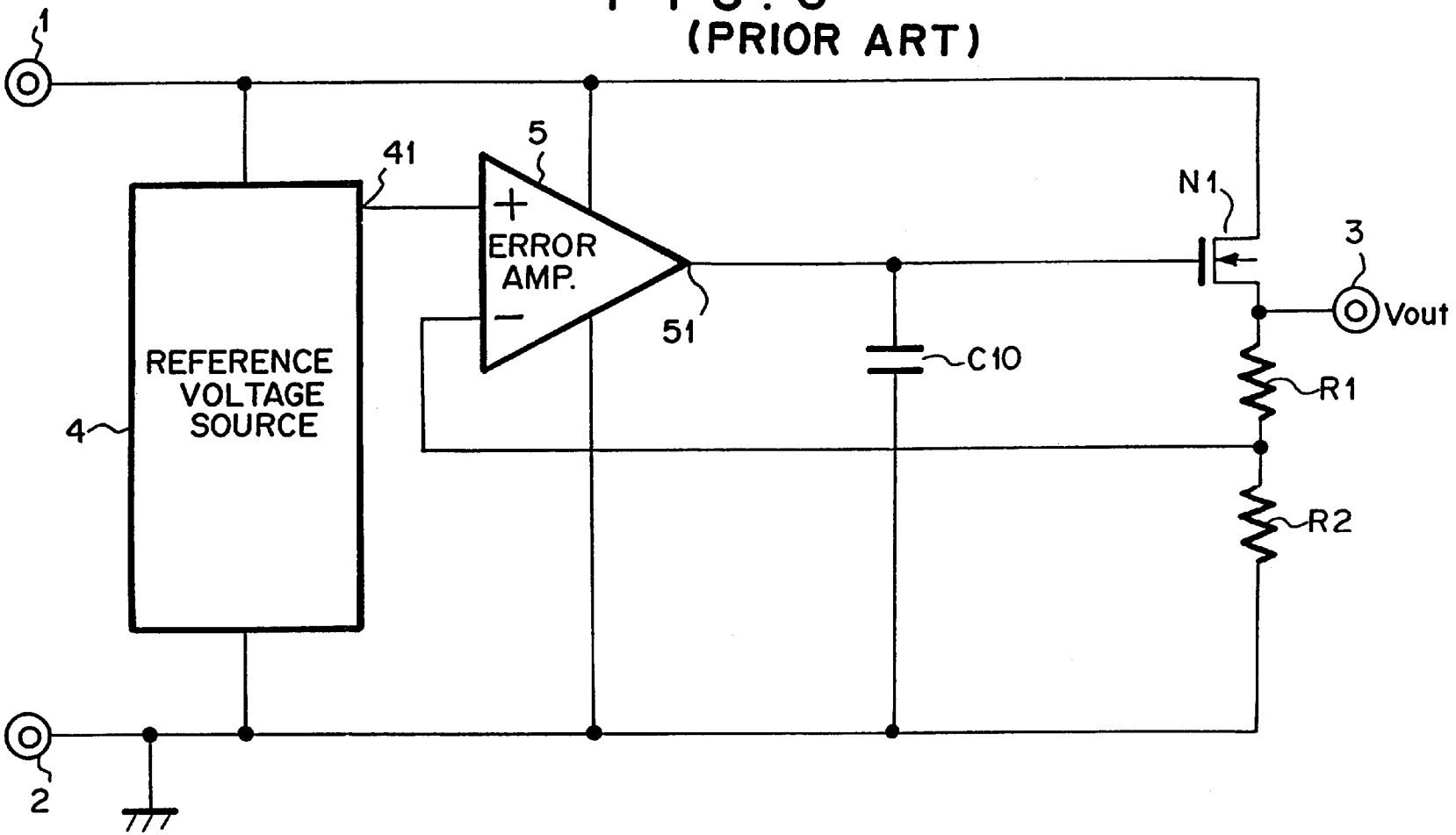
FIG. 6 (PRIOR ART)
FIG. 6 is a circuit diagram showing a conventional voltage regulator.
Figure 7:
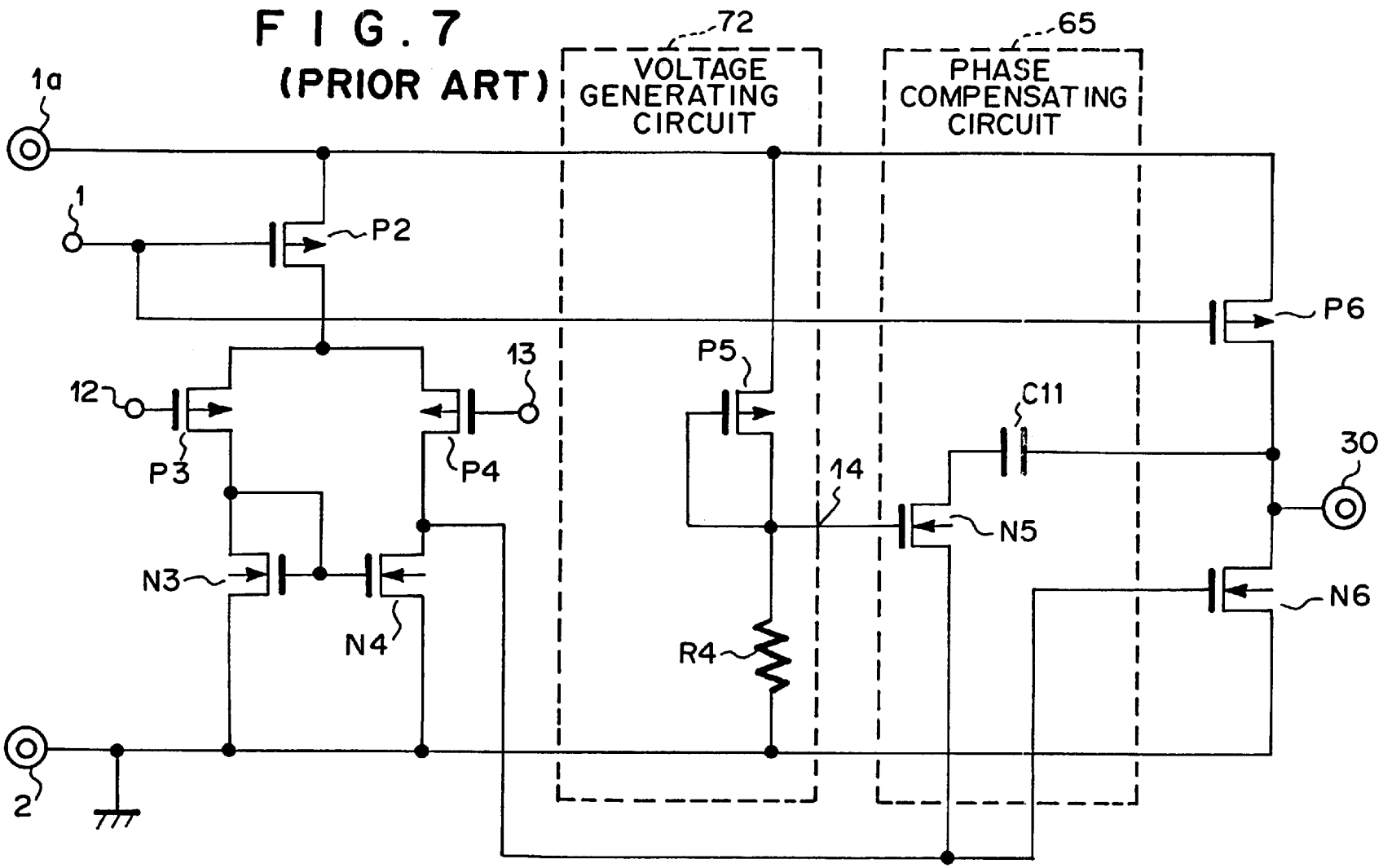
FIG. 7 (PRIOR ART)
FIG. 7 is a circuit diagram showing a conventional operational amplifier.

The voltage regulator according to this embodiment comprises phase compensating circuit 61 in addition to input terminal 1, ground terminal 2, output terminal 3, reference voltage source 4, error amplifier 5, output transistor N1, resistor R1, R2 as shown in FIG. 6.

Phase compensating circuit 61 includes: N-channel MOS transistor N2 having a drain connected to input terminal 1 and a gate connected in common to the gate of output transistor N1 and output terminal 51 of error amplifier 5; phase compensating capacitor C1 having one end portion connected to the gate of output transistor N1 and output terminal 51 of error amplifier 5; P-channel MOS transistor P1 having a source connected to the source of the N-channel MOS transistor N2, a gate and a drain connected together with the other end portion of capacitor C1; and voltage generating circuit 71 having terminal 8 connected in common to the gate and drain of P-channel transistor P1 and terminal 9 connected to ground terminal 2.

Next, voltage generating circuit 71 according to the present invention will be explained with reference to the circuit diagrams shown in FIGS. 2A–2E.

Figure 2A:
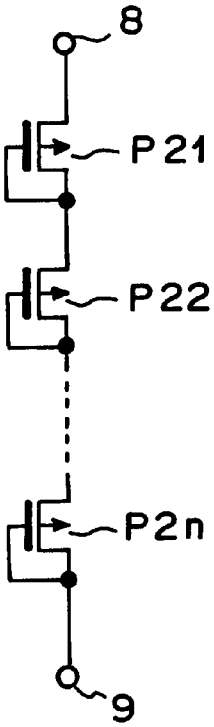
FIGS. 2A to 2E are a circuit diagrams showing a voltage generating circuit contained in the voltage regulator of the present invention.
Figure 2B:
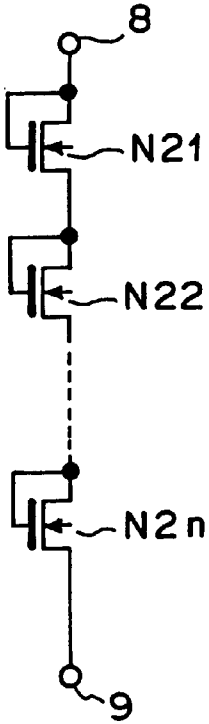

Voltage generating circuits shown in FIGS. 2A and 2B are configured by serially connecting, between terminal 8 and terminal 9, one or more of diode-connected P-channel MOS transistors P21–P2n and N-channel MOS transistors N21–N2n, respectively. A gate and a drain of each of the transistors are connected to each other. A voltage generated across terminal 8 and terminal 9 can be freely determined by adjusting the number of serially connected transistors.

Figure 2C:
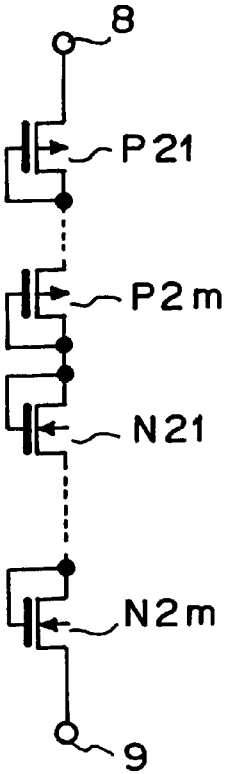

A voltage generating circuit shown in FIG. 2C is configured by serially connecting, between terminal 8 and terminal 9, one or more diode-connected P-channel MOS transistors P21–P2m and one or more N-channel MOS transistors N21–N2m. A gate and a drain of each of transistors are connected to each other.

Generally, as thresholds of the P-channel MOS transistor and the N-channel MOS transistor are different from each other, the output voltage can be determined more finely by adjusting the numb er of the P-channel MOS transistors and the N-channel MOS transistors to be connected in series. Further, a temperature coefficient of the voltage generated at terminal 8 can also be adjusted.

Figure 2D:
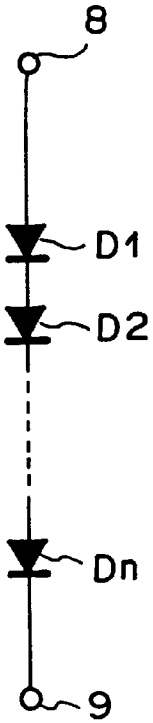

A voltage generating circuit shown in FIG. 2D is configured by serially connecting, between terminal 8 and terminal 9, one or more of diodes D1–Dn each including a PN junction between a source or drain and a well, for example. It has a feature in which a current driving capability is high and a variation of the generated voltage is low.

Figure 2E:
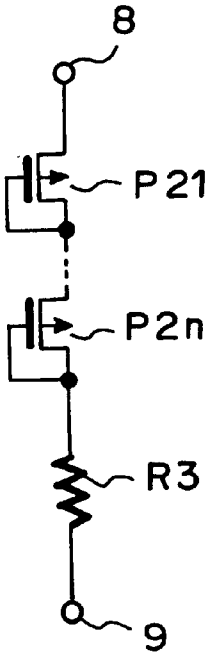

A voltage generating circuit shown in FIG. 2E includes resistor R3 serially inserted anywhere in any of the voltage generating circuits shown in FIGS. 2(*a*)–(*d*). By selecting the resistance value of resistor R3, a desired voltage can be generated at terminal 8. In order to elevate the output voltage generated at terminal 8, only increasing the resistance is required. Thus, a layout area of the voltage generating circuit can be decreased.

Arrangements of FIGS. 2A–2E can be freely combined together. For example, the diode chain of FIG. 2D may be inserted into the arrangements of FIGS. 2A or 2B.

Next, phase compensating circuit 61 which is included in the voltage regulator according to this embodiment will be explained.

In FIG. 1, when the output voltage Vout at output terminal 3 is 15V, voltage V(H) at the high potential side and voltage V(L) at the low potential side of capacitor C1 are given by the following equations (3) and (4), respectively:

$$V(H)=Vout+Vgs(N1) \quad (3)$$

$$V(L)=V(H)-Vgs(Nb\ 2)-Vgs(P1) \quad (4),$$

where Vgs(N2) and Vgs (P1) denote gate-source voltages of N-channel MOS transistor N2 and P-channel MOS transistor P1 respectively. Voltage V(C1) applied across capacitor C1 is derived from equations (3) and (4) and represented by:

$$V(C1)=V(H)-V(L)=Vgs(N2)+Vgs(P1) \quad (5).$$

As understood from the above equation (5), voltage V(CL) applied across capacitor C1 does not depend on output voltage Vout and is Vt(P)+Vt(N) , which is approximately 1.2V at the highest, where Vt(P) and Vt(N) denote threshold values of the P-channel MOS transistor and the N-channel MOS transistor, respectively. Namely, although the high potential side voltage V(H) is as high as about 15.6 V, as the low potential side voltage V(L) is also elevated up to a high potential by voltage generating circuit 71, the voltage applied across capacitor C1 becomes a low potential.

Therefore, even if forming capacitor C1 with the gate oxide film having the large capacity value per unit area, as the voltage applied across capacitor C1 is sufficiently low, the gate oxide film for forming capacitor C1 can not be broken down. Therefore, the area size of capacitor C1 can be reduced, and an area of a semiconductor substrate, on which the voltage regulator according to the present invention is integrated, can also be reduced.

Although explained above is the case where the gate oxide film is used as the insulating film for forming the capacitor, other insulating films, for example, a nitride film and a tantalum oxide $Ta_2O_5$ may also be used.

Next, a voltage regulator according to the second embodiment of the present invention will be explained with reference to FIG. 3.

The voltage regulator of this embodiment is similar to the voltage regulator shown in FIG. 1 except that current regulator 10 is inserted between input terminal 1 and the drain of N-channel MOS transistor N2.

By means of current regulator 10, a constant current flows through N-channel MOS transistor N2, P-channel MOS transistor P1 and voltage generating circuit 71 regardless of the input voltage applied to input terminal 1. Therefore, there is an advantage that the circuit operation of the phase compensating circuit becomes more stable.

Figure 4:
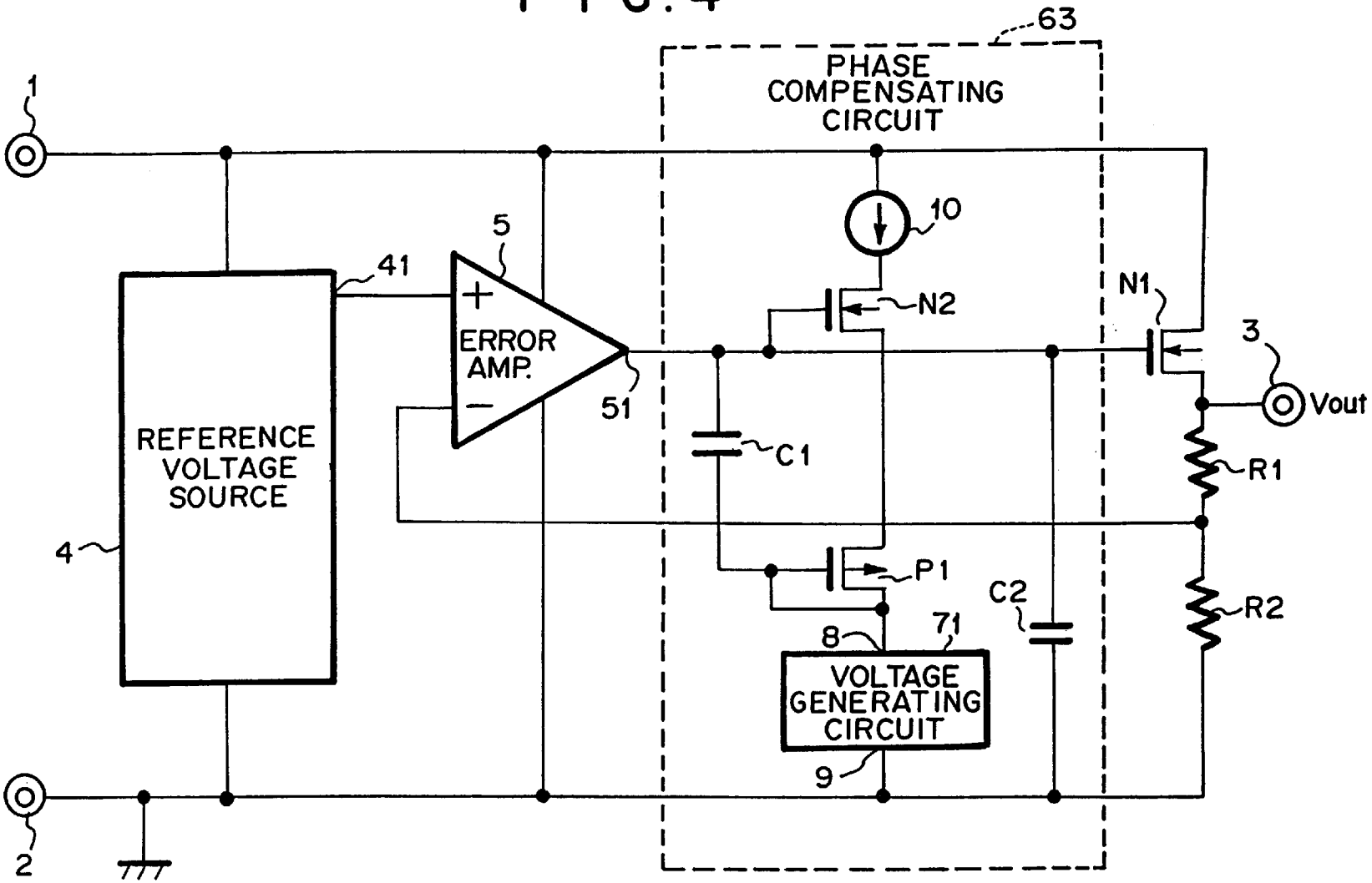
FIG. 4 is a circuit diagram showing a voltage regulator according to a third embodiment of the present invention.

Next, a voltage regulator according to the third embodiment of the present invention will be explained with reference to FIG. 4.

Figure 3:
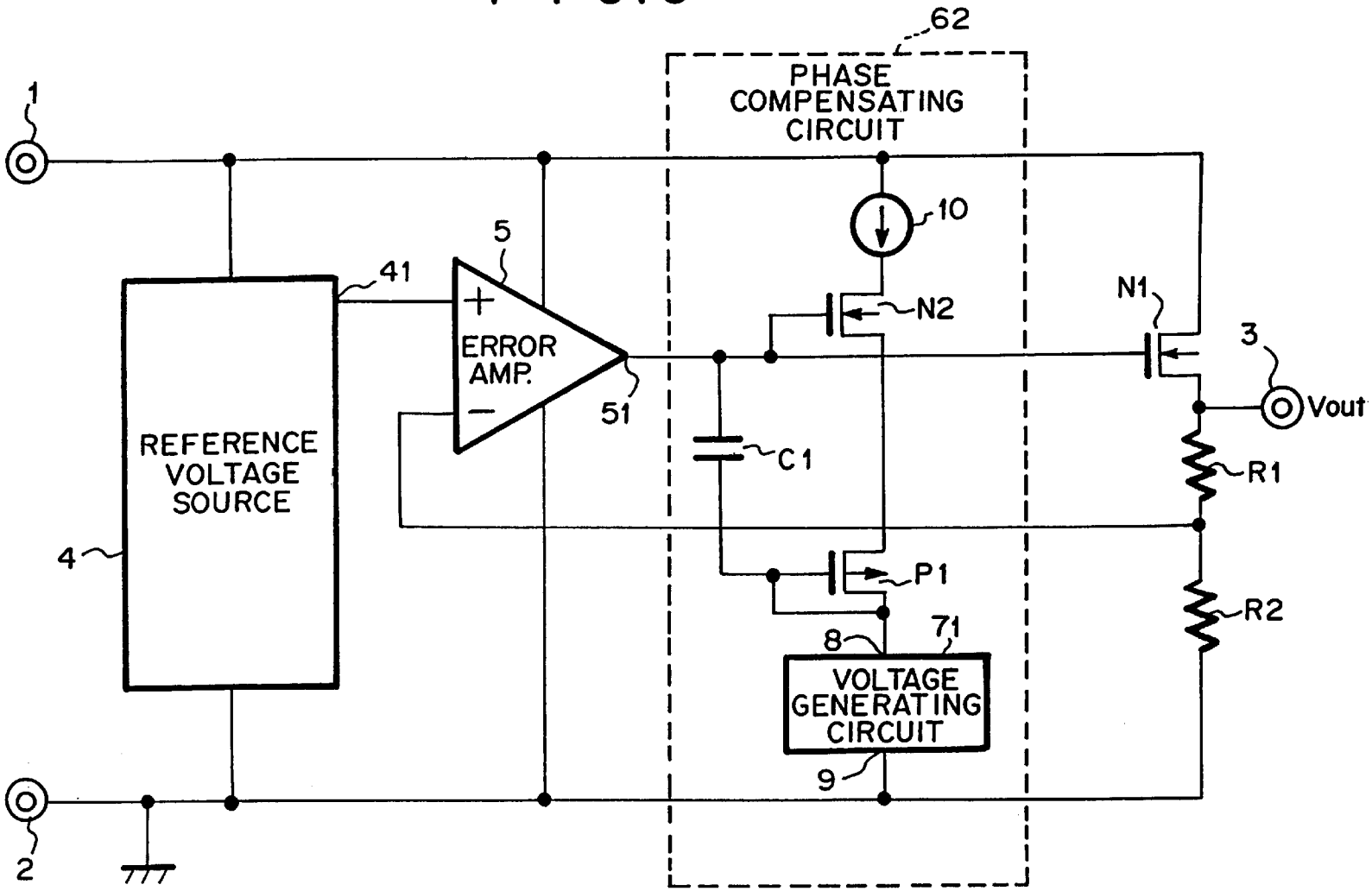
FIG. 3 is a circuit diagram showing a voltage regulator according to a second embodiment of the present invention.

The voltage regulator of this embodiment is similar to the voltage regulator shown in FIG. 3 except that a second phase compensating capacitor C2 is inserted between the gate of output transistor N1 and ground terminal 2.

By adding capacitor C2, an AC impedance, on viewing the ground terminal from output terminal 51 of error amplifier 5, can further be reduced. Therefore, a phase margin of the whole voltage regulator can further be increased. Since the voltage applied to capacitor C2 becomes large, an insulating film of capacitor C2 is formed thicker than the insulating film for forming capacitor C1.

Figure 5:
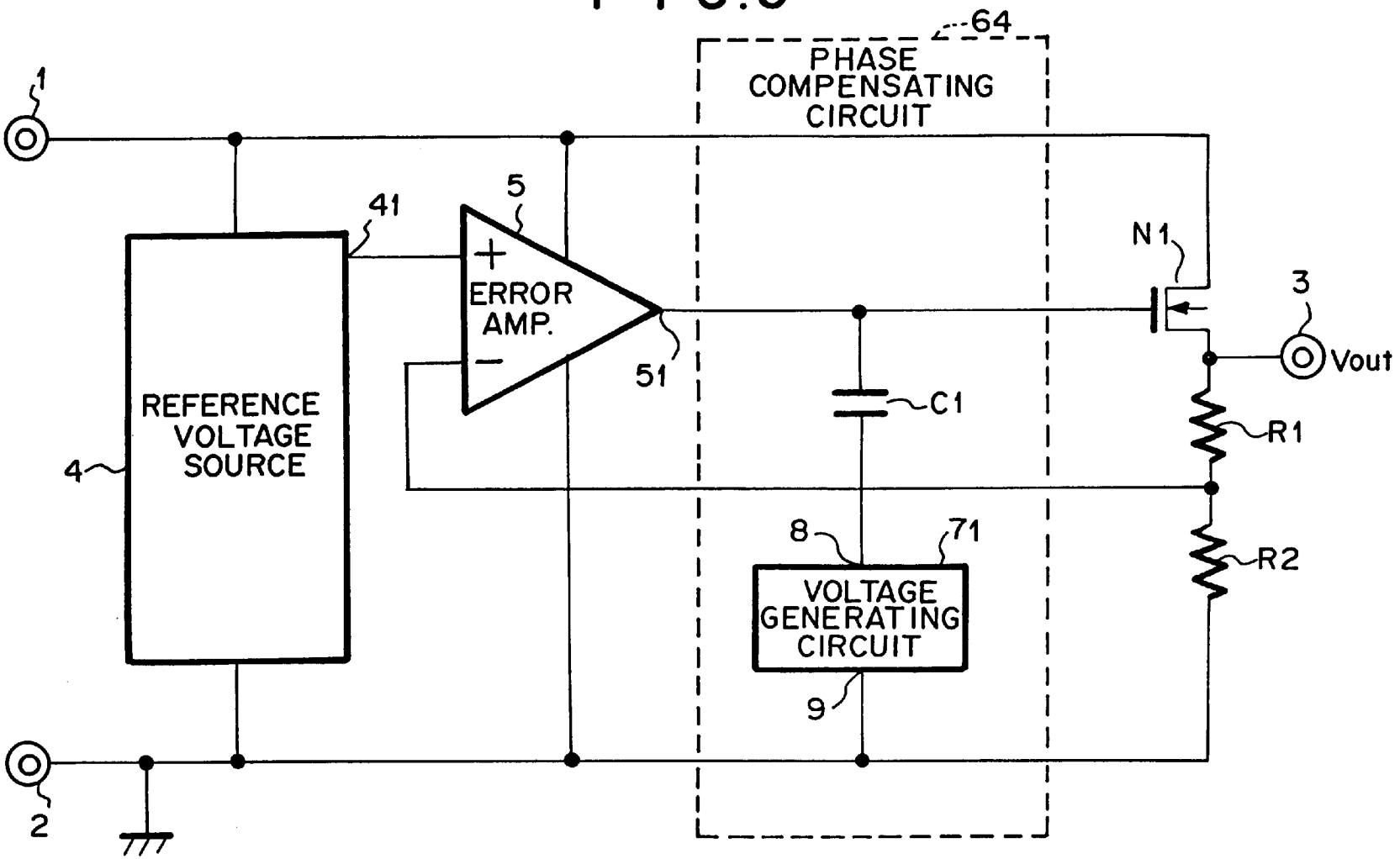
FIG. 5 is a circuit diagram showing a voltage regulator according to a fourth embodiment of the present invention.

Next, a voltage regulator according to the fourth embodiment of the present invention will be explained with reference to FIG. 5.

Phase compensating circuit 64 for configuring the voltage regulator of this embodiment consists of phase compensating capacitor C1 and voltage generating circuit 71, and has an advantage that the number of elements becomes less because of a simple configuration.

Since the voltage at the high potential side of capacitor C1 is relatively high, the voltage at the low potential side of capacitor C1 is adjusted by voltage generating circuit 71 so as to lower voltage V(C1) applied across capacitor C1.

In the above, although only such the case where the phase compensating circuit is adapted to the voltage regulator is described, the phase compensating circuit that forms the characterized parts of the present invention can be applied not only to the voltage regulator but similarly to another circuit arrangement that drives a gate of an output transistor by an output of an amplifier.

As explained above, in the voltage regulator according to the present invention, even when the output voltage becomes higher, the voltage applied across the phase compensating capacitor for forming the phase compensating circuit remains low. Thus, the insulating film for forming the phase compensating capacitor can be made thinner.

Therefore, the area size of the voltage regulator which includes the phase compensating capacitor and the phase compensating circuit can be reduced.

Having explained preferred embodiments of the present invention, it will now become apparent to those of ordinary skill in the art that other embodiments incorporated these concepts may be used. Accordingly, it is submitted that the invention should not be limited to the explained embodiments but rather should be limited only by the spirit and scope of the appended claims.

What is claimed is:

1. A voltage regulator which comprises:

an input terminal for receiving an input voltage;

a ground terminal;

a final output terminal;

a reference voltage source for outputting a reference voltage;

an output transistor for outputting a constant output voltage which has a drain connected to said input terminal and a source connected to said final output terminal;

an amplifier for amplifying said reference voltage which has an output terminal connected to a gate of said output transistor; and a phase compensating circuit connected to said output terminal of said amplifier, wherein said phase compensating circuit comprises:

a voltage generating circuit for generating a constant voltage;

a first MOS transistor having a drain connected to said input terminal and a gate connected to said output terminal of said amplifier;

a second MOS transistor having a source connected to said source of said first MOS transistor, and a drain and a gate connected in common to an output terminal of said voltage generating circuit; and a first phase compensating capacitor having two terminals, one of said two terminals being connected to said gate of said first MOS transistor and the other of said two terminals being connected to said gate of said second MOS transistor.

2. The voltage regulator according to claim 1, which further comprises a voltage dividing circuit for outputting a divided voltage of said constant output voltage which is connected between said final output terminal and said ground terminal, wherein said amplifier amplifies a differential voltage between said reference voltage applied to a non-inverting input terminal and said divided voltage applied to an inverting input terminal.

3. The voltage regulator according to claim 1, which further comprises a current regulator for flowing a constant current which is inserted between said input terminal and said drain of said first MOS transistor.

4. The voltage regulator according to claim 1, which further comprises a second phase compensating capacitor for phase compensation which is inserted between said gate of said output transistor and said ground terminal.

5. The voltage regulator according to claim 1, wherein an insulating film between both electrodes of said first phase compensating capacitor comprises a gate film of a MOS transistor.

6. The voltage regulator according to claims 1, wherein said voltage generating circuit comprises a serial circuit containing any one or more selected from a group consisting of P-channel transistors each having a gate and a drain connected to each other, N-channel transistors each having a gate and a drain connected to each other, PN junction diodes, and resistors.

7. The voltage regulator according to claim 4, wherein an insulating film between both electrodes of said second phase compensating capacitor comprises a gate film of a MOS transistor.

8. A voltage regulator which comprises:

an input terminal for receiving an input voltage;

a ground terminal;

a final output terminal;

a reference voltage source for outputting a reference voltage;

an output transistor for outputting a constant output voltage which has a drain connected to said input terminal and a source connected to said final output terminal;

an amplifier for amplifying said reference voltage which has an output terminal connected to a gate of said output transistor; and a phase compensating circuit connected to said output terminal of said amplifier, wherein said phase compensating circuit comprises:

a voltage generating circuit for generating a constant voltage; and a phase compensating capacitor having two terminals, one of said two terminals being connected to said gate of said output transistor and the other of said two terminals being connected to an output terminal of said voltage generating circuit.

9. The voltage regulator according to claim 8, which further comprises a voltage dividing circuit for outputting a divided voltage of said constant output voltage which is connected between said final output terminal and said ground terminal, wherein said amplifier amplifies a differential voltage between the reference voltage applied to a non-inverting input terminal and said divided voltage applied to an inverting input terminal.

10. The voltage regulator according to claim 8, wherein an insulating film between both electrodes of said first phase compensating capacitor comprises a gate film of a MOS transistor.

11. The voltage regulator according to claims 8, wherein said voltage generating circuit comprises a serial circuit containing any one or more selected from a group consisting of P-channel transistors each having a gate and a drain connected to each other, N-channel transistors each having a gate and a drain connected to each other, PN junction diodes, and resistors.

* * * * *

UNITED STATES PATENT AND TRADEMARK OFFICE

CERTIFICATE OF CORRECTION

PATENT NO.: 6,049,200
DATED: April 11, 2000
INVENTOR(S): Hajime HAYASHIMOTO

It is certified that error(s) appears in the above-identified patent and that said Letters Patent is hereby corrected as shown below:

Column 2, line 18, delete "N15" insert --N5--;

line 33, delete "N15" insert --N5--;

Column 5, line 61, delete "CL" insert --C1--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*